US006494631B1

(12) United States Patent
Mastinick

(10) Patent No.: US 6,494,631 B1
(45) Date of Patent: Dec. 17, 2002

(54) PRINTER WITH RIBBON FOLD OUT MECHANISM

(75) Inventor: Philip Alan Mastinick, Camarillo, CA (US)

(73) Assignee: Z.I.H. Corp., Wilmington, DE (US)

( * ) Notice: Subject to any disclaimer, the term of this patent is extended or adjusted under 35 U.S.C. 154(b) by 0 days.

(21) Appl. No.: 09/675,193

(22) Filed: Sep. 29, 2000

(51) Int. Cl.[7] ..... B41J 35/28; B41J 29/54; B41J 33/14

(52) U.S. Cl. ..... 400/208; 400/206.2; 400/223; 400/248.1; 400/248.2; 400/663; 400/664

(58) Field of Search ..... 400/120.1, 191, 400/192, 194, 196, 196.1, 206.2, 208, 224.2, 225, 235.1, 236.1, 236.2, 246, 248.1, 248.2, 250, 613, 663, 668, 690.4, 692, 693

(56) References Cited

U.S. PATENT DOCUMENTS 4,632,585 A * 12/1986 Oyamatsu et al. ..... 400/613
4,689,639 A 8/1987 Kimura et al.
4,718,785 A * 1/1988 Spath ..... 400/224.2
4,754,290 A * 6/1988 Kitayama et al. ..... 400/196
5,128,763 A * 7/1992 Sakuragi ..... 400/208
5,165,806 A * 11/1992 Collins ..... 400/208
5,193,919 A * 3/1993 Godo et al. ..... 400/208
5,424,757 A * 6/1995 Thom ..... 400/120.01
5,424,760 A * 6/1995 Wirth et al. ..... 400/120.01
5,672,020 A 9/1997 Leonard et al.
5,741,080 A * 4/1998 Tomoda et al. ..... 400/208
5,791,796 A * 8/1998 Gustavsson et al. ... 400/120.01
5,938,351 A 8/1999 Hamisch, Jr. et al.

* cited by examiner

*Primary Examiner*—Eugene H. Eickholt
(74) *Attorney, Agent, or Firm*—Fulbright & Jaworski LLP

(57) ABSTRACT

A ribbon mechanism mounted in the lid of a printer includes a ribbon carriage pivotally coupled to the lid for folding out of the lid by virtue of its mass when the lid is open and for folding in the lid as the lid is closed. A gear train is mounted on the ribbon carriage for driving the ribbon take up core. A thermal printhead is resiliently mounted in the ribbon carriage and automatically aligned against the platen with alignment tabs. The ribbon carriage is movably linked to a printer hinge by way of a linkage having an elongated slot at one end for slidably engaging an integral ribbon carriage post and with an aperture at the other end for pivotally mating with a lever arm provided on the printer hinge. The ribbon carriage post slides linearly inside the linkage slot between maximum "down"/maximum "up" positions at each end of the linkage slot, respectively.

32 Claims, 14 Drawing Sheets

PRINTER WITH RIBBON FOLD OUT MECHANISM

BACKGROUND OF THE INVENTION

1. Field of the Invention

The present invention relates generally to printers and more particularly to a ribbon fold out mechanism mounted in the lid of a thermal printer to facilitate loading of ribbon media and printhead maintenance.

2. Prior Art

A thermal printer is usually provided with a printhead which comprises a large number of exothermic resistors arranged on an electrically insulating base. By selectively applying electric current to the exothermic resistors, heat is generated and applied to a thermo-sensitive print medium so as to print characters, pictures or both. The basic construction of a conventional thermal transfer printer includes a platen, thermal printhead, ribbon supply and take up mechanism, stepping motor and a gear train for driving the platen. A continuous strip of print media (e.g., paper, cloth, etc.) usually from a clamped print media roll is positioned between the platen and the ribbon with the thermal printhead caused to press the ribbon against the print media thereby printing characters or pictures on the print media strip using heat generated from the thermal printhead.

One of the most important aspects for the user in setting up a thermal transfer printer for printing is ribbon and media loading. Ribbon loading in conventional thermal transfer printers is a complicated, generally undesirable task which frequently involves ten or more steps. The usual steps are unlatching the printer, opening the lid of the printer, loading the ribbon supply roll, loading the ribbon take up roll, opening up the ribbon mechanism, threading the ribbon, wrapping the ribbon around the ribbon mechanism, taping it to the ribbon take up roll, taking up the ribbon slack, closing the lid of the printer and finally, re-latching the printer. Of the above-described steps, ribbon threading is usually the most difficult step to accomplish and as such can be a source of frustration for the user. Media loading usually requires the user to thread the media under or through the ribbon mechanism. Furthermore, conventional thermal transfer printers do not provide easy access to the thermal printhead for maintenance which adds to the overall cost of meeting the printing needs of the average user.

Therefore, the need arises for an improved low cost thermal transfer printer which significantly reduces the number of steps involved in ribbon and media loading. Such a printer should preferably be capable of loading ribbon and media without having to thread through/around the ribbon mechanism. The need also arises for a thermal transfer printer which provides easier access to the thermal printhead for regular maintenance by the user.

SUMMARY OF THE INVENTION

The present invention meets the above needs and is directed to a printer comprising a base having a platen, a lid coupled to the base, the lid having an open position and a closed position, a ribbon mechanism coupled to the lid, means for driving the ribbon mechanism and the platen when the lid is in the closed position and means for automatically presenting the ribbon mechanism for loading of ribbon when the lid is in the open position.

These and other aspects of the present invention will become apparent from a review of the accompanying drawings and the following detailed description of the preferred embodiments of the present invention.

DETAILED DESCRIPTION OF THE PREFERRED EMBODIMENTS

Figure 1:
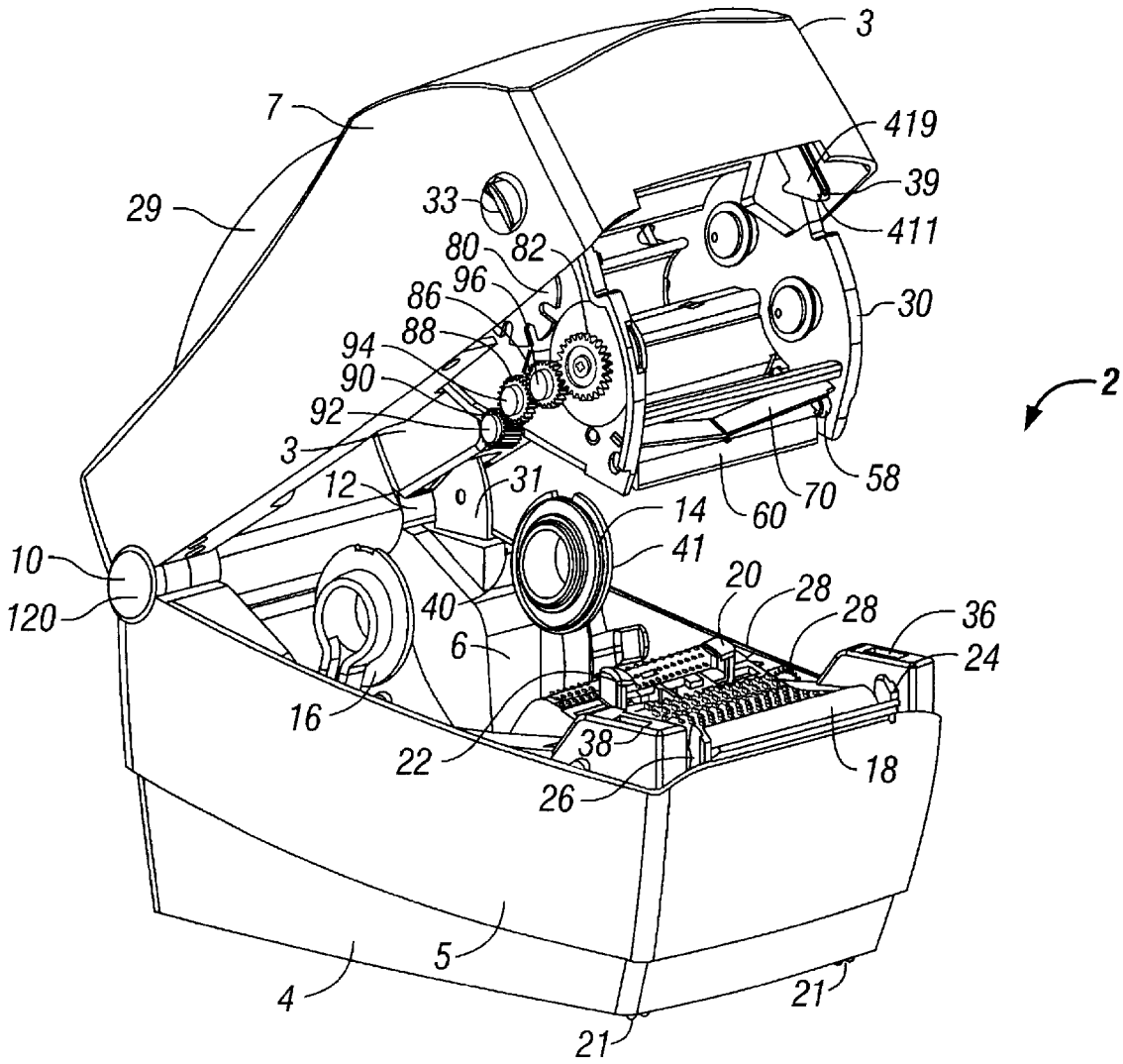
FIG. 1 is a perspective view of a printer in accordance with the present invention.

Hereinafter, some preferred embodiments of the present invention will be described in detail with reference to the related drawings of FIGS. 1–16. Additional embodiments, features and/or advantages of the invention will become apparent from the ensuing description or may be learned by the practice of the invention.

In the figures, the drawings are not to scale and reference numerals indicate the various features of the invention, like numerals referring to like features throughout both the drawings and the description.

The following description includes the best mode presently contemplated for carrying out the invention. This description is not to be taken in a limiting sense, but is made merely for the purpose of describing the general principles of the invention.

The present invention is directed to a printer, generally referred to by reference numeral 2, which can be used for thermal transfer printing (with ribbon) or for direct thermal printing (without ribbon) as needed by the user (FIG. 1).

As shown in FIGS. 1–4, printer 2 comprises a base 4 having a lower frame 6 hinged to an upper frame 8 of a printer lid 3 by way of hinges 10, 12. Hinge 12 is an integral part of lower frame 6, while hinge 10 is a separate removable part adapted for mounting to one end of lower frame 6. Lower frame 6 is screwed to a base cover 5 to form base 4 and upper frame 8 is screwed to a lid cover 7 to form printer lid 3. The bottom of base cover 5 may be provided with a plurality of support legs, such as support legs 21 in FIG. 1.

Lower frame 6 is used for mounting a platen 18, a pair of adjustable print media (paper, cloth and the like) roll holders 14, 16, a pair of adjustable print media guides 20, 22, a pair of printhead alignment tabs 24, 26, a lower gear train 201 (FIG. 14—one of the gears is not shown), a stepping motor 13 (FIG. 14) and a main circuit board (not shown) for controlling the operation of printer 2. A portion 28 on the outer surface of lower frame 6 is conventionally ribbed to reduce the surface contact area for the passing print media. Base 4 may be further provided in the back with a power switch (not shown), a power jack (not shown) for coupling an external power supply, a serial port (not shown), a parallel port (not shown) and/or a universal serial bus (USB) port (not shown) for connecting printer 2 to a computer or other device.

Figure 10:
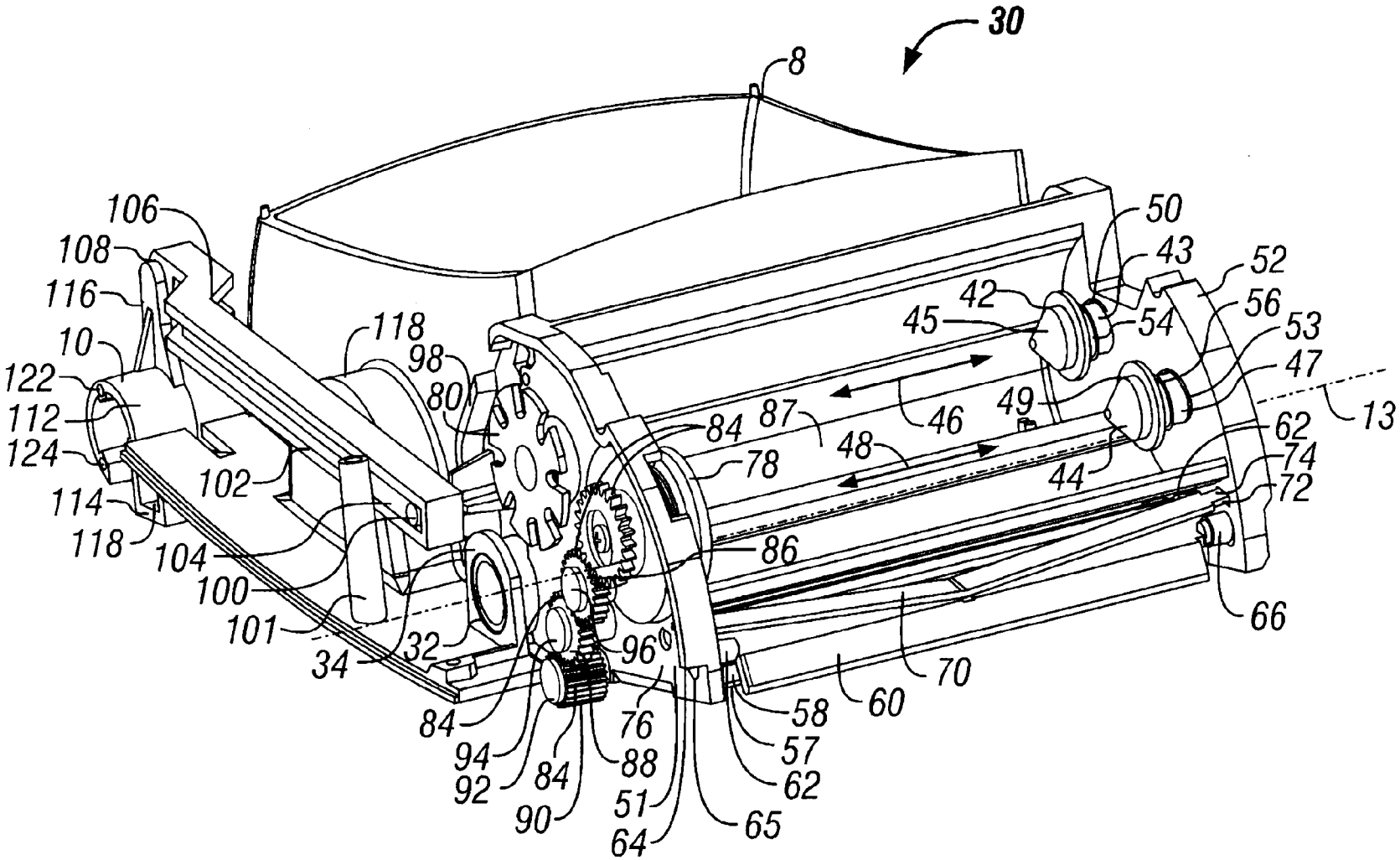
FIG. 10 is a perspective view of the internal structure of the printer lid shown in FIG. 9 in accordance with the present invention.
Figure 11:
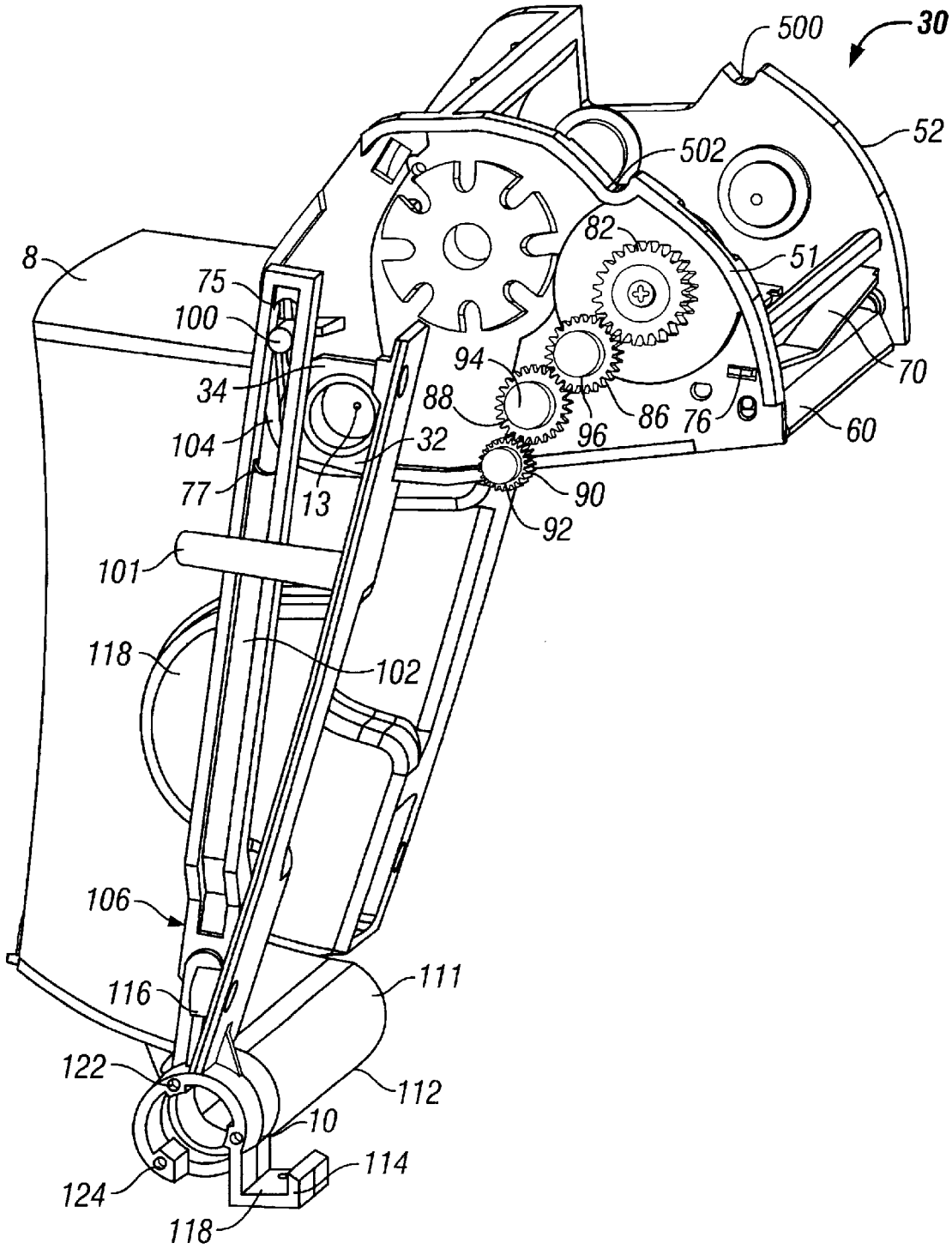
FIG. 11 is a perspective view of yet another preferred embodiment of the present invention.

Upper frame 8 is used to pivotally mount a ribbon carriage 30 designed to receive a ribbon supply roll (not shown), a ribbon take up roll/core (not shown) and a thermal printhead 58 (FIG. 10). Ribbon carriage 30 may be injection molded as one piece from a suitable light-weight material. For example, ribbon carriage 30 may be injection molded from polycarbonate material containing 15% carbon fiber and 2% silicone for stiffness and static charge dissipation. The ribbon take up roll/core is driven by an upper gear train 84 (FIGS. 3, 4, 8) mounted on one side of ribbon carriage 30. Upper gear train 84 is driven by lower gear train 201which in turn is driven by a shaft 203 (FIG. 14) of stepping motor 13.

Figure 12:
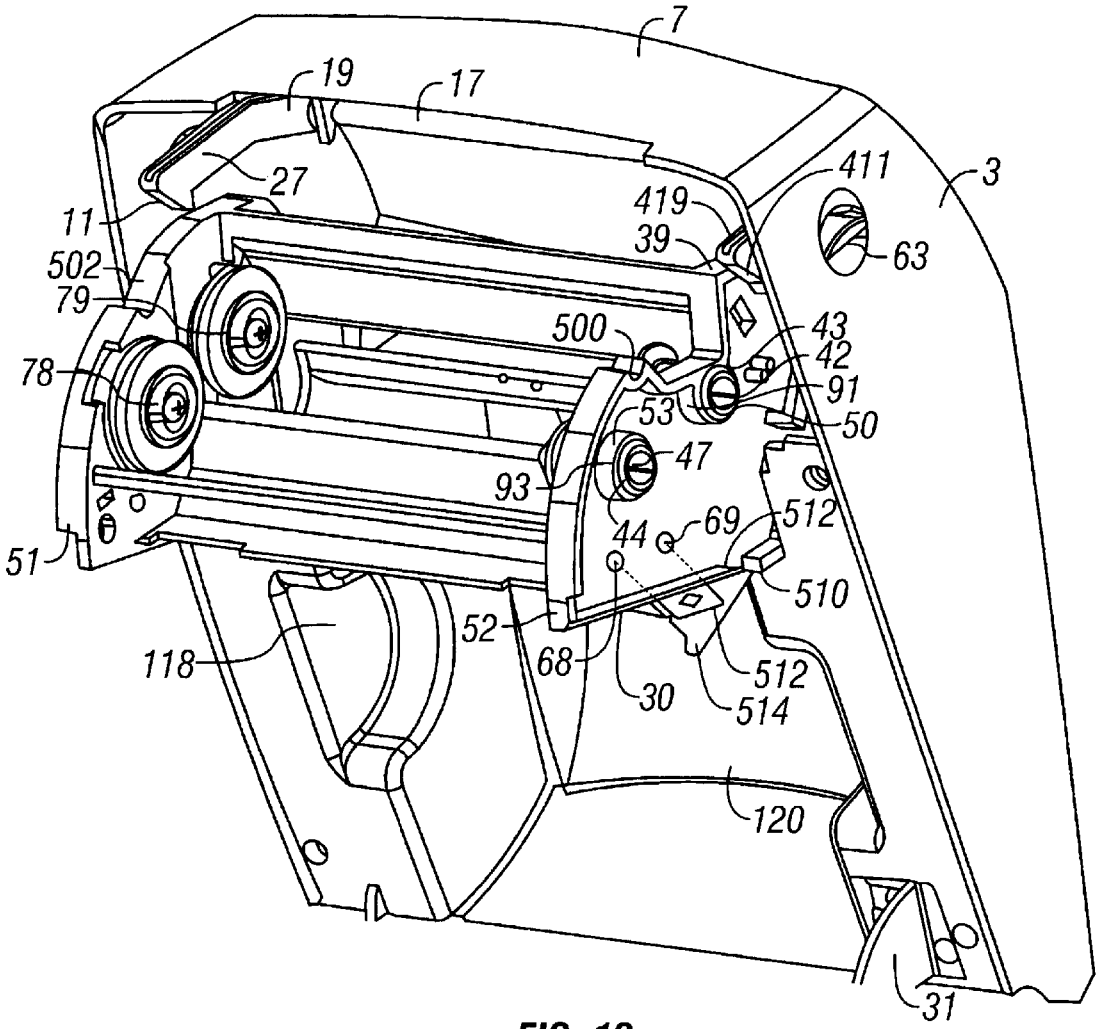
FIG. 12 is a perspective view of a printer lid for use in accordance with the present invention.
Figure 15:
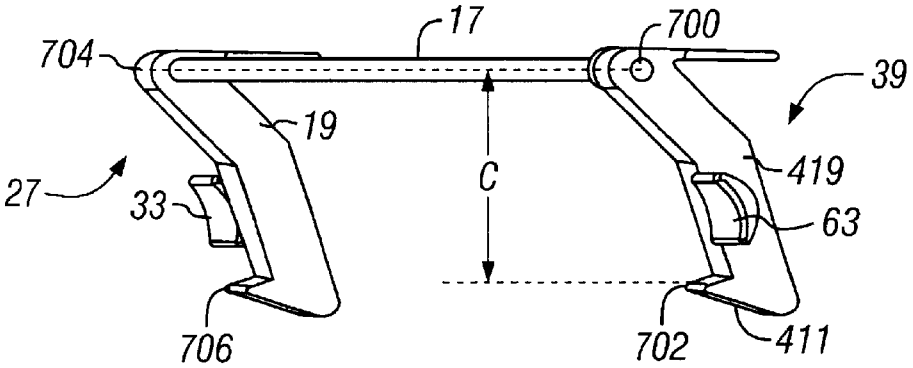
FIG. 15 is a perspective view of a latching system for use in accordance with the present invention.

Lid 3 is preferably provided with a see-through dome 29 to permit lid 3 to be closed with a large roll of print media (paper) held by adjustable print media roll holders 14, 16. Lid 3 is also provided generally in its top portion with a pair of spaced apart latches, such as latch 39 in FIG. 1 and latch 27 in FIG. 12. Latch 27 has a generally hook-like body 19 which ends with a substantially flat outer foot 11 for engaging a corresponding latch opening 38 (FIG. 1) provided at the front end of lower frame 6 of base 4 when lid 3 is in a fully closed position so as to lock printer 2 during printer operation. As illustrated in FIGS. 1 and 12, latch 39 similarly has a generally hook-like body 419 which ends with a substantially flat outer foot 411 for engaging a corresponding latch opening 36 (FIG. 1) provided at the front end of lower frame 6 of base 4. As shown in FIGS. 12 and 15, latch 27 and latch 39 are mounted on a latch shaft 17 made preferably of light weight metal (such as aluminum) with latch shaft 17 hinged generally in the upper inner portion of lid 3 on a pair of integral spaced apart plastic clips (not shown). Latch 27 is provided with an integral latch release 33 (FIGS. 1, 15) for manually turning latch 27 inward (toward the interior of lid 3) so as to release (unlock) lid 3 from base 4. Similarly, latch 39 is provided with an integral latch release 63 (FIGS. 12, 15) for manually turning latch 39 inward (toward the interior of lid 3) so as to release (unlock) lid 3 from base 4.

Furthermore, as shown in FIGS. 1–4, a lid lock 31 is provided for automatically locking lid 3 in a fully open position in accordance with the present invention. Lid lock 31, which is preferably made of plastic and shaped generally as an annular strip, is mounted at one end of upper frame 8 for mating with a corresponding lid lock slot 40 provided respectively at one end of lower frame 6 (FIGS. 1–4). Lid lock 31 has a generally outwardly (toward the exterior side wall of base 4) curved bottom portion 37 for engaging a corresponding channel 41 provided adjacent lid lock slot 40. Lid lock 31 is mounted at one end of upper frame 8 such that its outwardly curved bottom portion 37 is aligned for automatic engagement in channel 41 when lid 3 is fully open to prevent lid 3 from closing by itself. To close lid 3, the user manually pushes lid lock 31 inward (toward the interior of lower frame 6) to disengage bottom portion 37 of lid lock 31 from channel 4l which allows lid lock 31 to move frictionally inside slot 40 (i.e., acts like a spring) as lid 3 is closed by the user. At the fully open position for lid 3, lid lock 31 automatically snaps out of slot 40 with its outwardly curved bottom portion 37 engaging channel 41 to prevent lid 3 from closing on its own by virtue of its mass. Other lid lock arrangements may be used, provided such other arrangements do not deviate from the intended purpose of the present invention.

Ribbon carriage 30 is provided on one side with a spring loaded plastic supply hub 42 and a spring loaded plastic take up hub 44 disposed proximate to supply hub 42 for removably engaging one end of a ribbon supply roll and a ribbon take up core, respectively (FIG. 10). As shown in FIG. 12, ribbon carriage 30 is provided on the other side with a take up clutch assembly 78 and a supply clutch assembly 79 disposed proximate to take up clutch assembly 78 for removably engaging the other end of a ribbon take up/supply roll, respectively. Supply clutch assembly 79 is mounted (e.g., screwed) on a plastic fan-like supply spindle 80 disposed on the other (exterior) side of side wall 51 of ribbon frame 30 (FIGS. 10, 12). Take up clutch assembly 78 is mounted (e.g., screwed) on a take up gear 82 disposed on the other (exterior) side of side wall 51 of ribbon frame 30 (FIGS. 10, 12) which takes up ribbon slack.

Figure 8:
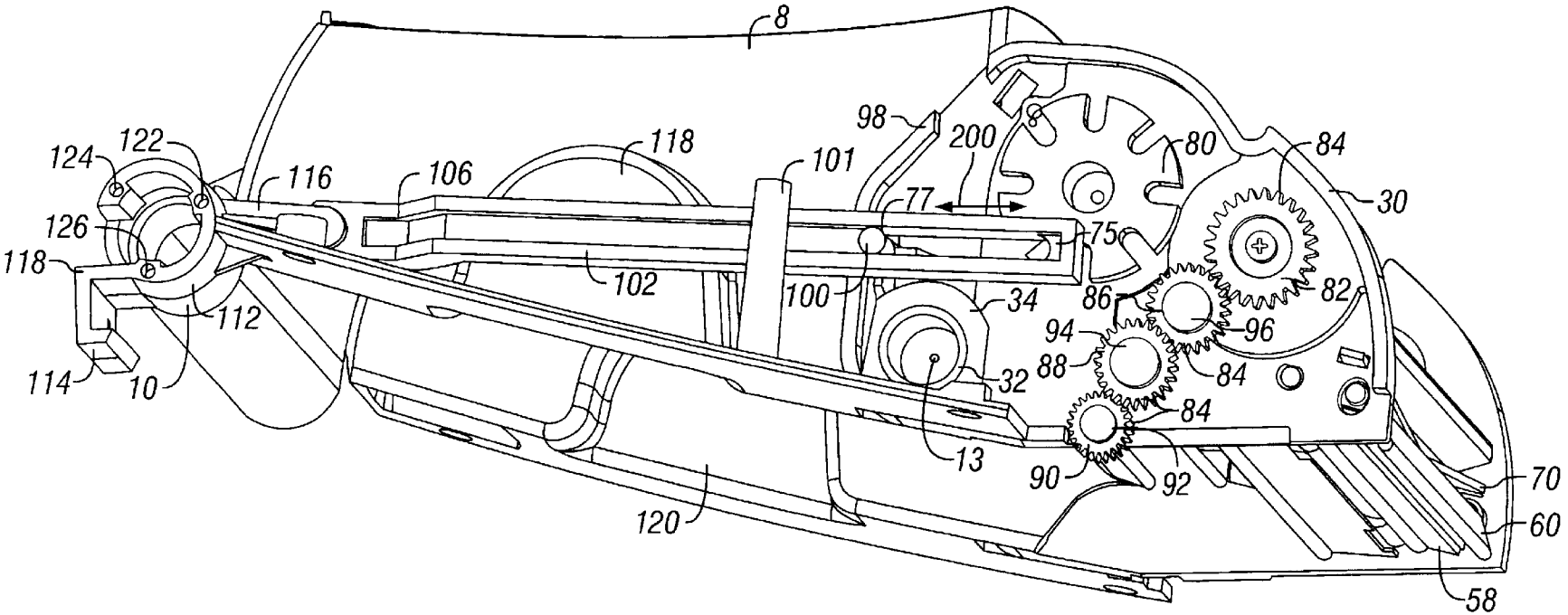
FIG. 8 is a perspective view of the internal structure of the printer lid shown in FIG. 7 in accordance with the present invention.

As shown in FIGS. 8 and 10, take up gear 82 is part of an upper gear train 84 (FIG. 8) which also includes a first idler gear 86 operatively coupled between take up gear 82 and a second idler gear 88 which, in turn, is operatively coupled between first idler gear 86 and a transfer gear 90. When lid 3 is fully closed, power from lower gear train 201 is transferred to upper gear train 84 by way of transfer gear 90 which in this position is operatively coupled to a third idler gear 202 (FIG. 14) which is part of lower gear train 201.

Figure 14:
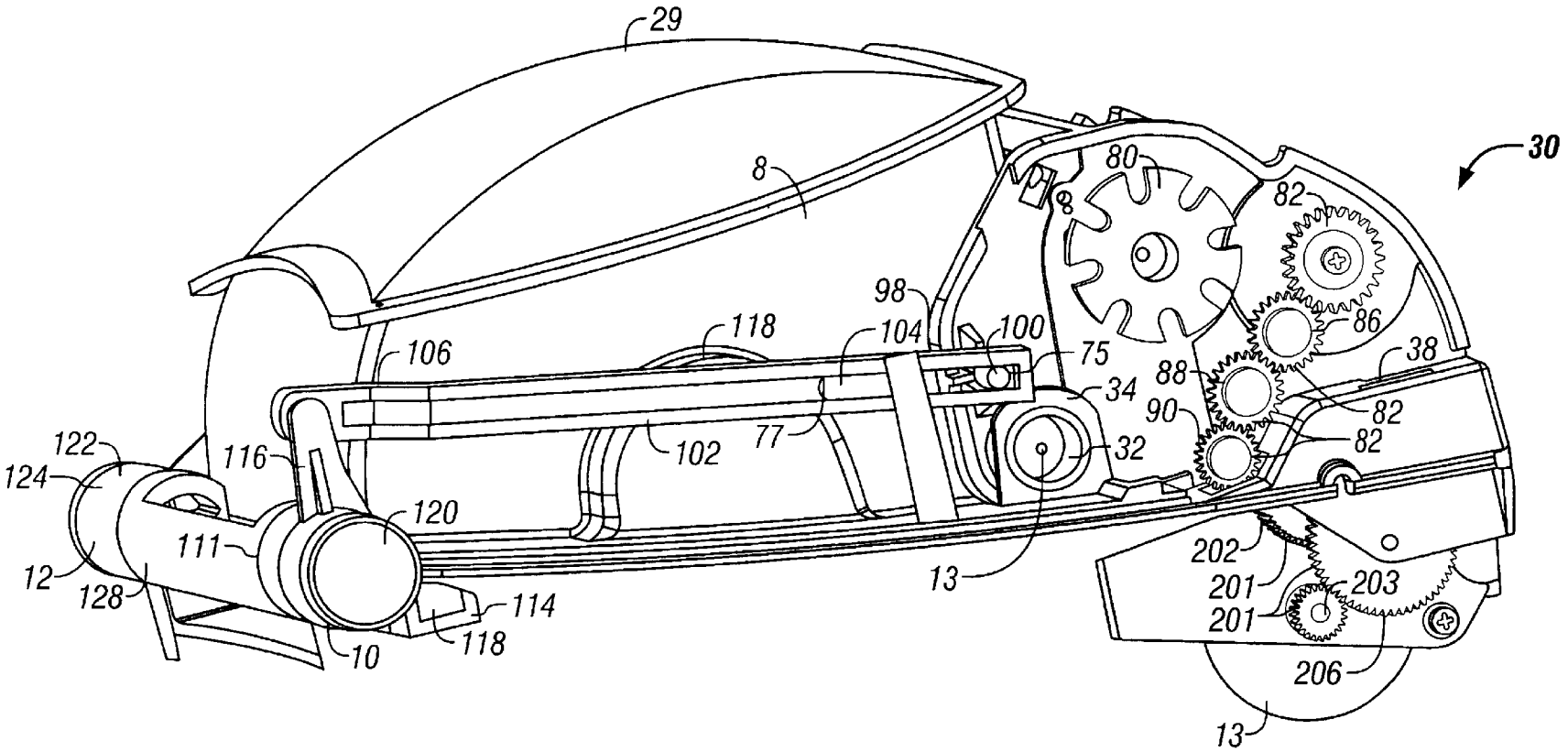
FIG. 14 is a perspective view of a different embodiment of the present invention.
Figure 16:
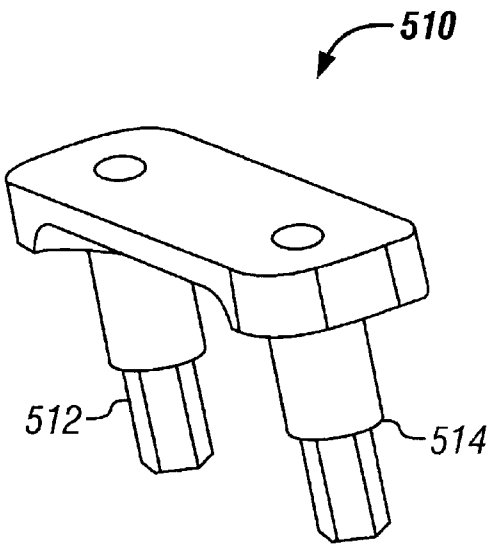
FIG. 16 is a perspective view of a mounting clip for use in accordance with the present invention.

As shown in FIG. 14, lower gear train 201 is mounted on lower frame 6 of base 4 and further includes a pinion gear 204 coupled to shaft 203 of stepping motor 13, a compound gear 206 driven by pinion gear 204 and a platen gear (not shown) coupled to the shaft (not shown) of platen 18 for driving platen 18 during printer operation. Compound gear 206 drives third idler gear 202 which in turn drives the platen gear. The operation of stepping motor 13 is controlled by the main circuit board (not shown). A stepping motor suitable for practicing the present invention may be purchased from Mitsumi Electronics Corporation of Santa Clara, Calif. First and second idler gears 86, 88 and transfer gear 90 are preferably mounted on the exterior side of side wall 51 of ribbon frame 30 with press-in pins 96, 94, 92, respectively, for easy mounting (FIG. 10).

As shown in FIG. 10, supply hub 42 has a cylindrical hollow body 43 with a cone-shaped integral cap 45. Cylindrical hollow body 43 is movably mounted in an aperture 50 of side wall 52 of ribbon carriage 30. Cylindrical body 43 is preferably spring loaded with a coiled helical spring 54 coupled between the bottom of cone-shaped cap 45 and the interior surface of side wall 52 of ribbon carriage 30. Spring 54 allows cylindrical body 43 to be displaced linearly within aperture 50 as shown by arrow 46 during manual loading and unloading of a ribbon supply roll by the user. As best shown in FIG. 12, the back portion of cylindrical hollow body 43 is provided with stop tabs 91 which abut against the outer surface of aperture 50 on the exterior side of side wall 52 preventing cylindrical hollow body 43 from slipping inside aperture 50.

Similarly, take up hub 44 has a cylindrical hollow body 47 with a cone-shaped integral cap 49. Cylindrical body 47 is movably mounted in an aperture 53 of side wall 52 of ribbon carriage 30. Cylindrical hollow body 47 is preferably spring loaded with a coiled helical spring 56 coupled between the bottom of integral cone-shaped cap 49 and the interior surface of side wall 52 of ribbon carriage 30. Spring 56 allows cylindrical body 47 to be displaced linearly within aperture 53 as shown by arrow 48 during manual loading and unloading of a ribbon take up roll (core) by the user. As best shown in FIG. 12, the back portion of cylindrical hollow body 47 is provided with stop tabs 93 which abut against the outer surface of aperture 53 on the exterior side of side wall 52 preventing cylindrical hollow body 47 from slipping inside aperture 53. Other types of ribbon roll loading arrangements may be used in conjunction with ribbon carriage 30 as long as such arrangements fall within the scope of the present invention.

As further illustrated in FIG. 10, ribbon carriage 30 is also used for mounting a floating thermal printhead 58 of the type described in U.S. Pat. No. 6,068,415 to Smolenski, assigned to the assignee of the present application, the disclosure of which is incorporated herein by reference. A thermal printhead suitable for the practice of the present invention may be purchased, for example, from Rohm Co., Ltd. of Kyoto, Japan.

Thermal printhead 58 is fastened with two screws (not shown) to the underside of a generally V-shaped printhead support bracket 60 (FIG. 10) preferably made of the same material as ribbon carriage 30 and removably hinged at each end to side walls 51, 52 of ribbon carriage 30, respectively. Thermal printhead 58 is electrically connected by way of cables 62 with the main circuit board (not shown) housed in base 4 of printer 2. A main circuit board suitable for use with the present invention can be purchased, for example, from the assignee of the present invention.

As depicted in FIG. 10, printhead support bracket 60 is preferably backed up by a compression leaf spring 70 which can be made from a steel strip bent to a certain extent generally in the middle. Leaf spring 70 is removably attached to side wall 52 of ribbon frame 30 by way of a first integral elongated leg 72 and a corresponding leaf spring aperture 74 in side wall 52 and to side wall 51 of ribbon frame 30 by way of a second integral elongated leg (not shown) and a corresponding leaf spring aperture 76 (FIG. 11) in side wall 51 of ribbon frame 30. In one example, leaf spring 70 may be made from a generally V-shaped 0.050 inch thick steel strip.

As shown in FIG. 10, printhead support bracket 60 is removably mounted to side wall 51 of ribbon carriage 30 by way of a pair of integral mounting posts such as post 64 (second post not shown) and a pair of corresponding printhead support bracket apertures such as aperture 65 (FIG. 10) on side wall 51 of ribbon carriage 30 (second aperture not shown) adapted for mating with the pair of integral mounting posts such as post 64.

Printhead support bracket 60 is removably mounted to side wall 52 of ribbon carriage 30 by way of a pair of integral hollow bosses such as hollow boss 66 in FIG. 10 (second boss not shown), a pair of corresponding printhead support apertures 68, 69 (FIG. 12) on side wall 52 of ribbon carriage 30 adapted for mating with the pair of integral hollow bosses such as hollow boss 66 and a press-in printhead clip 510 (FIGS. 12, 16) which has two prongs 512, 514, respectively, adapted for insertion (FIG. 12) from the exterior side of side wall 52 through apertures 68, 69 into the respective pair of integral hollow bosses (such as boss 66) of printhead support bracket 60 to allow easy mounting/dismounting of printhead support bracket 60 by the user. Each pair of printhead support bracket apertures on wall 51 or wall 52 is appropriately cut to allow the integral mounting posts and the clipped hollow bosses of printhead support bracket 60 and, therefore, mounted printhead 58 to move or "float" to a certain extent in all three dimensions within their respective apertures on side walls 51, 52 to allow for adjustment of the orientation of printhead 58 vis-a-vis platen 18 for printer operation.

A person skilled in the art would readily appreciate that other methods of attaching and/or backing up thermal printhead 58 may be utilized, provided such other methods do not deviate from the intended purpose of the present invention.

To load a ribbon supply roll, the user pulls the adhesive strip from the ribbon supply roll free (not shown), extends the leader (not shown) through a ribbon carriage cutout 87 (FIG. 10) and couples (not shown) the ribbon supply roll between supply clutch assembly 79 and supply hub 42 which are shaped to accommodate and securely hold each end of the ribbon supply roll during printer operation. To load a ribbon take up roll (core), the user couples the ribbon take up roll between take up clutch assembly 78 and take up hub 44 (not shown) which are shaped to accommodate and securely hold each end of the ribbon take up roll during printer operation. Having installed the ribbon supply and take up rolls, the user pulls (not shown) the leader around printhead 58 and sticks (not shown) the adhesive strip to the take up roll. The user then manually winds take up gear 82 counter-clockwise (towards the installed ribbon supply roll) until the black ribbon portion is visible on the ribbon take up roll which completes the ribbon loading procedure (not shown).

Figure 4:
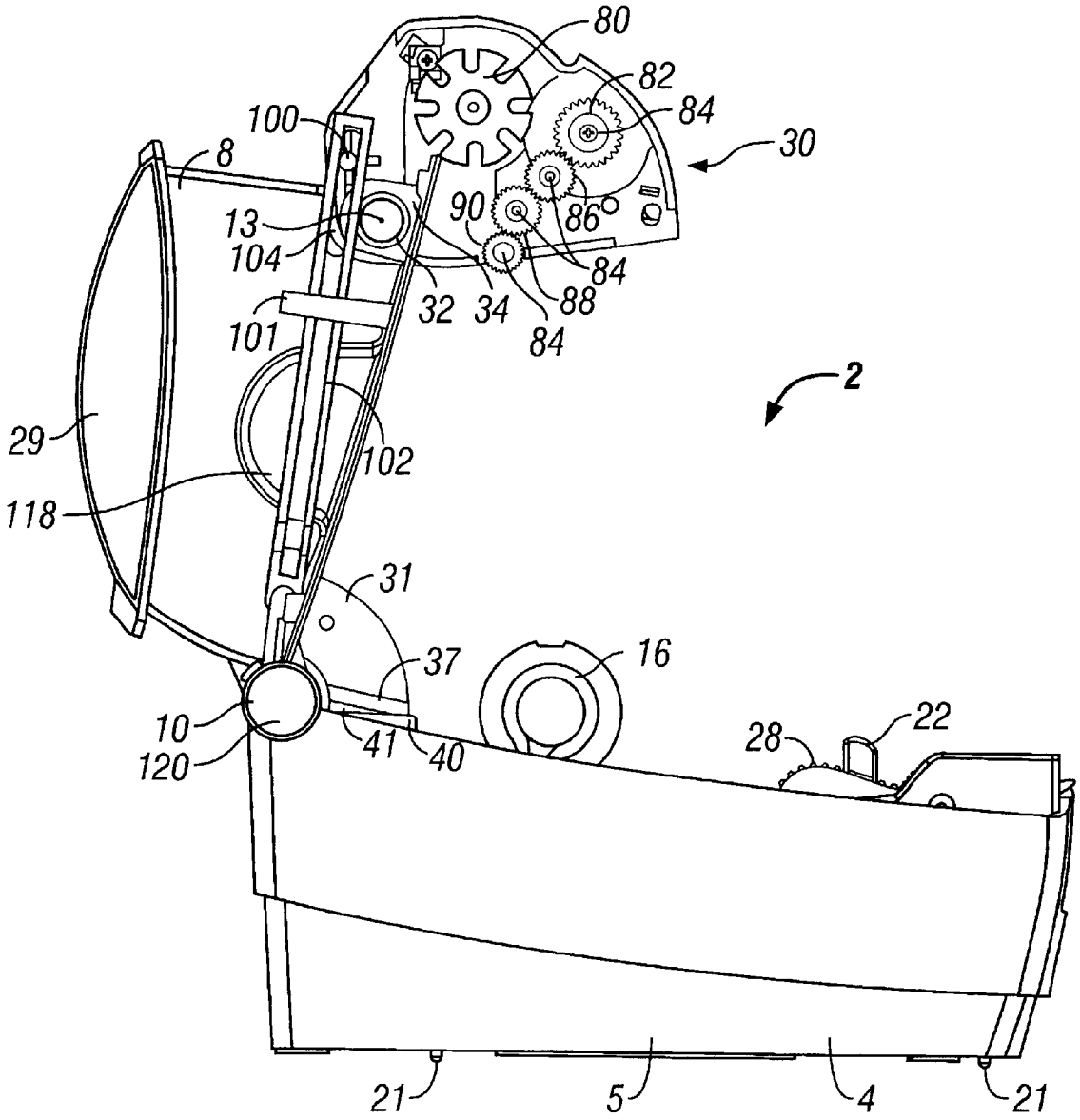
FIG. 4 is a side view of the printer shown in FIG. 3 in accordance with the present invention.
Figure 7:
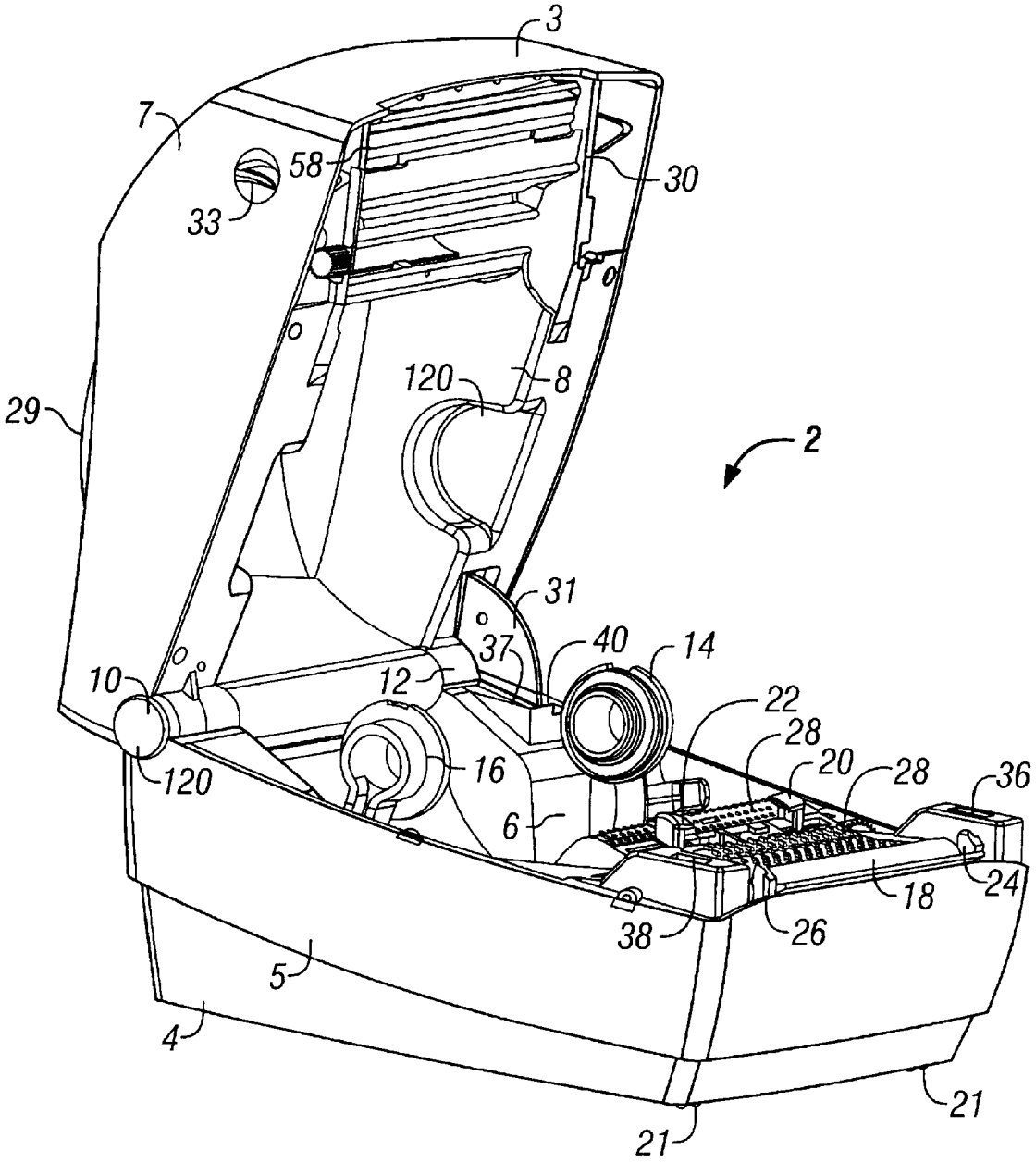
FIG. 7 is perspective view of a preferred embodiment of the present invention.

As further illustrated in FIGS. 4, 10 and in accordance with a preferred embodiment of the present invention, ribbon carriage 30 is hinged on each side to upper frame 8 of lid 3 by way of a pair of integral hollow cylindrical posts 32 (second post not shown) which mate with a corresponding pair of circular slots 34 (second circular slot not shown) provided on upper frame 8. A ribbon carriage axis of rotation (hinge axis) 13 may thus be defined through the center of hollow cylindrical post 32 as depicted in FIG. 10. As illustrated in FIGS. 1, 7, upper frame 8 and ribbon carriage 30 are configured to allow ribbon carriage 30 to rotatably fold in and out of lid 3 within a pre-determined angular range. Other materials, configurations and/or angular ranges may be used to practice the invention, provided such other materials, configurations and/or angular ranges fall within the scope of the present invention.

Figure 5:
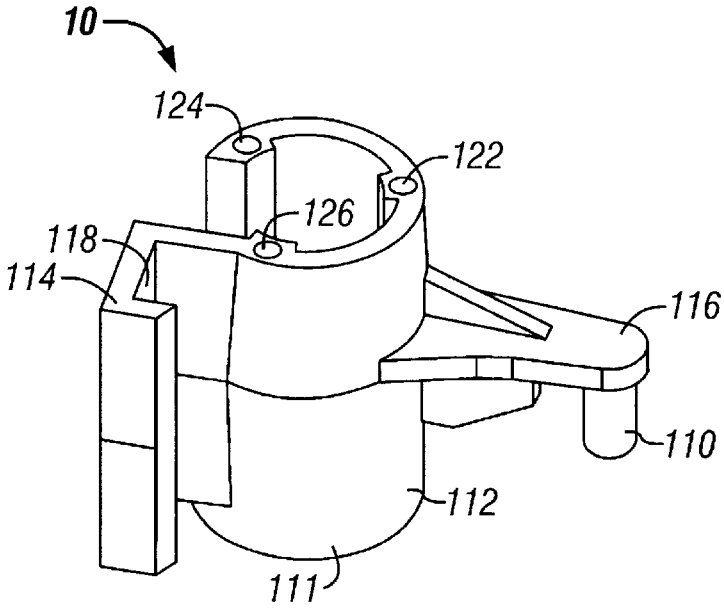
FIG. 5 is a perspective view of a hinge for use with the printer of FIG. 1 in accordance with the present invention.
Figure 6:
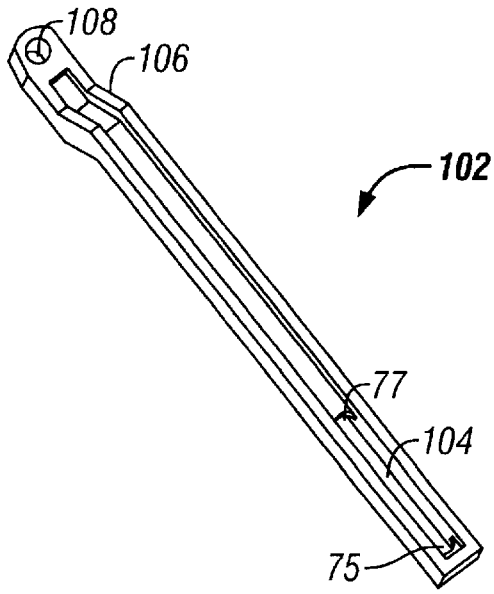
FIG. 6 is a perspective view of a linkage for use with the hinge of FIG. 5 in accordance with the present invention.

In accordance with another preferred embodiment of the present invention, aback portion 98 (FIG. 10) of ribbon carriage 30 is movably linked to printer hinge 10 by way of an elongated plastic linkage 102 (FIGS. 6, 10). Linkage 102 is preferably of I-beam-type construction for optimal structural strength and is provided at its ribbon carriage end with a generally rectangular slot 104 (FIGS. 6, 10) for movably accommodating a ribbon carriage post 100 which is an integral part of back portion 98 of ribbon carriage 30 (FIG. 10). Linkage 102 is hinged at the other end to printer hinge 10 by way of an aperture 108 (FIG. 6) adapted for receiving a lever arm 110 (FIG. 5) of hinge 10. Linkage 102 also has a jog 106 (FIG. 10) which, in the shown configuration, is needed to clear a bulge 118 (FIG. 10) provided on one of the exterior sides of upper platform 8 for accommodating print media roll holder 16 in accordance with the present invention. Thus, linkage 102 is captured between bulge 118 and a side boss 101 which is an integral part of upper frame 8 as shown in FIGS. 8–11. An identically shaped bulge 120 (FIGS. 7–8, 12) is provided on the other exterior side of upper frame 8 for accommodating print media roll holder 14, respectively. Other upper frame and linkage configurations may be utilized to practice the present invention provided such other configurations agree with the intended purpose of the present invention.

Linkage 102 has a stationary pivot at its printer hinge end and a dynamic pivot at its ribbon carriage end in accordance with the present invention. Dynamic pivoting is a result of ribbon carriage post 100 sliding linearly inside slot 104 of linkage 102 between a maximum "down" (FIG. 8) and a maximum "up" (FIG. 14) position, as shown by bi-directional arrow 200 in FIG. 8, as ribbon carriage 30 rotates about hinge axis 13 (FIG. 10) when lid 3 is being opened by the user for ribbon loading or printhead cleaning. Maximum "down" position for ribbon carriage post 100 is at a bottom end 77 of slot 104 of linkage 102 (FIGS. 6, 8) and corresponds to ribbon carriage 30 being in a fully folded in state, i.e. manually pushed all the way in lid 3 (lid 3 being in a fully open position) by the user for cleaning thermal printhead 58 (see also FIG. 7). Maximum "up" position for ribbon carriage post 100 is at a top end 75 (FIG. 6) of slot 104 of linkage 102 (FIGS. 9,14) and corresponds to lid 3 being in a fully closed position with floating printhead 58 aligned behind printhead alignment tabs 24, 26 (FIG. 1) in accordance with the present invention.

Figure 13:
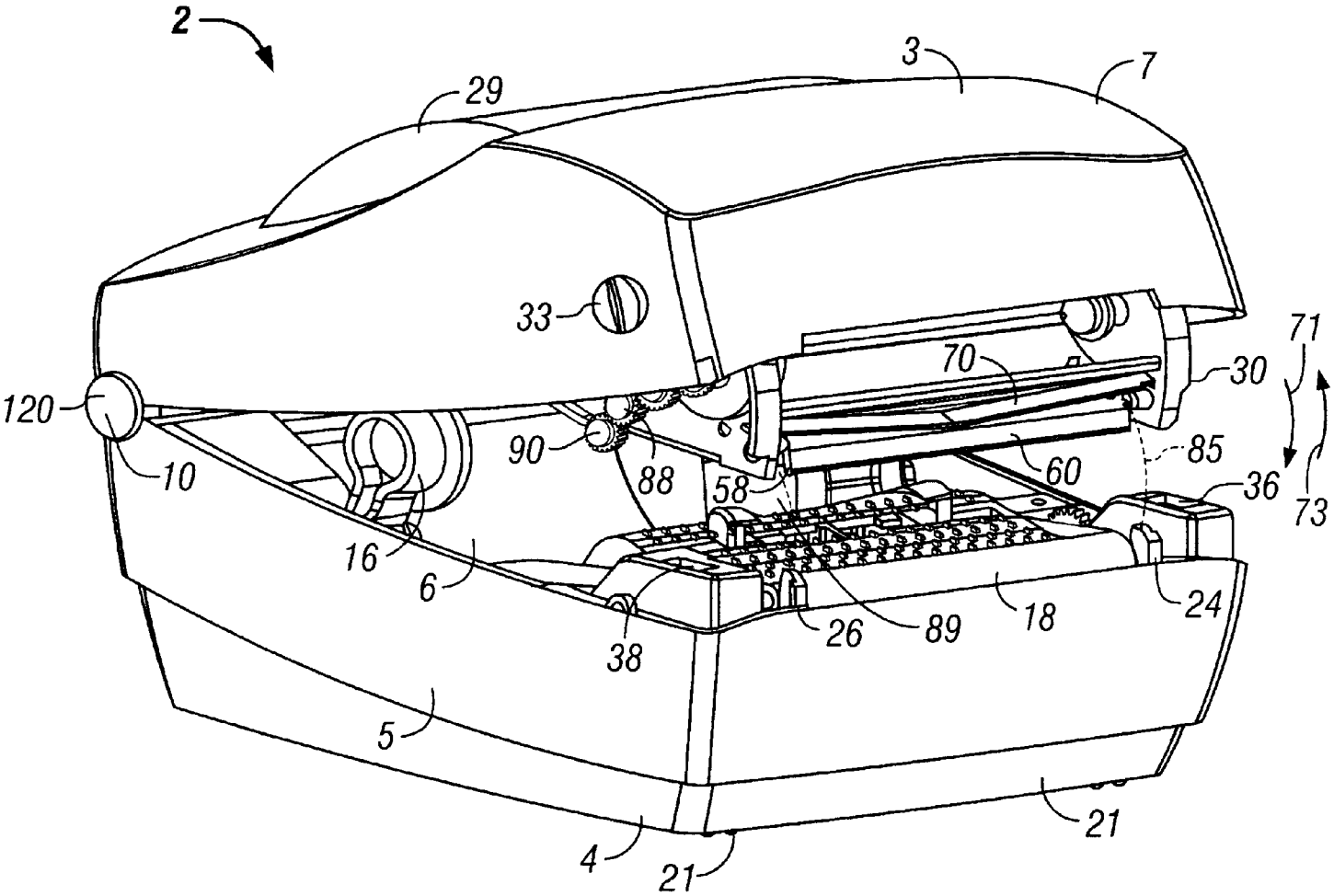
FIG. 13 is a perspective view of still another preferred embodiment of the present invention.

In accordance with the best mode for practicing the invention, as lid 3 is being opened from a fully closed position by the user, ribbon carriage 30 by virtue of its mass (i.e. under the force of gravity) rotates downwards (towards lower frame 6) about hinge axis 13 (FIG. 10) by itself In other words, as lid 3 is being opened, ribbon carriage 30 automatically folds out of lid 3 with the motion of the front edge of printhead 58 describing a downward arc 71 (FIG. 13). When lid 3 reaches a fully open position (lid lock 31 automatically latches lid 3 in the fully open position), ribbon carriage 30 is in a fully folded out state (FIGS. 1–4, 11) automatically presenting itself for easy ribbon and media loading. This is a marked improvement over the prior art method of loading new ribbon and media which involves a great number of steps and expenditure of time not to mention being frequently a source of frustration for the average user. When ribbon carriage 30 is in a fully folded out state, the position of ribbon carriage post 100 inside slot 104 is slightly offset from top end 75 of slot 104 as shown, for example, in FIG. 11 in accordance with the general principles of the present invention.

Figure 9:
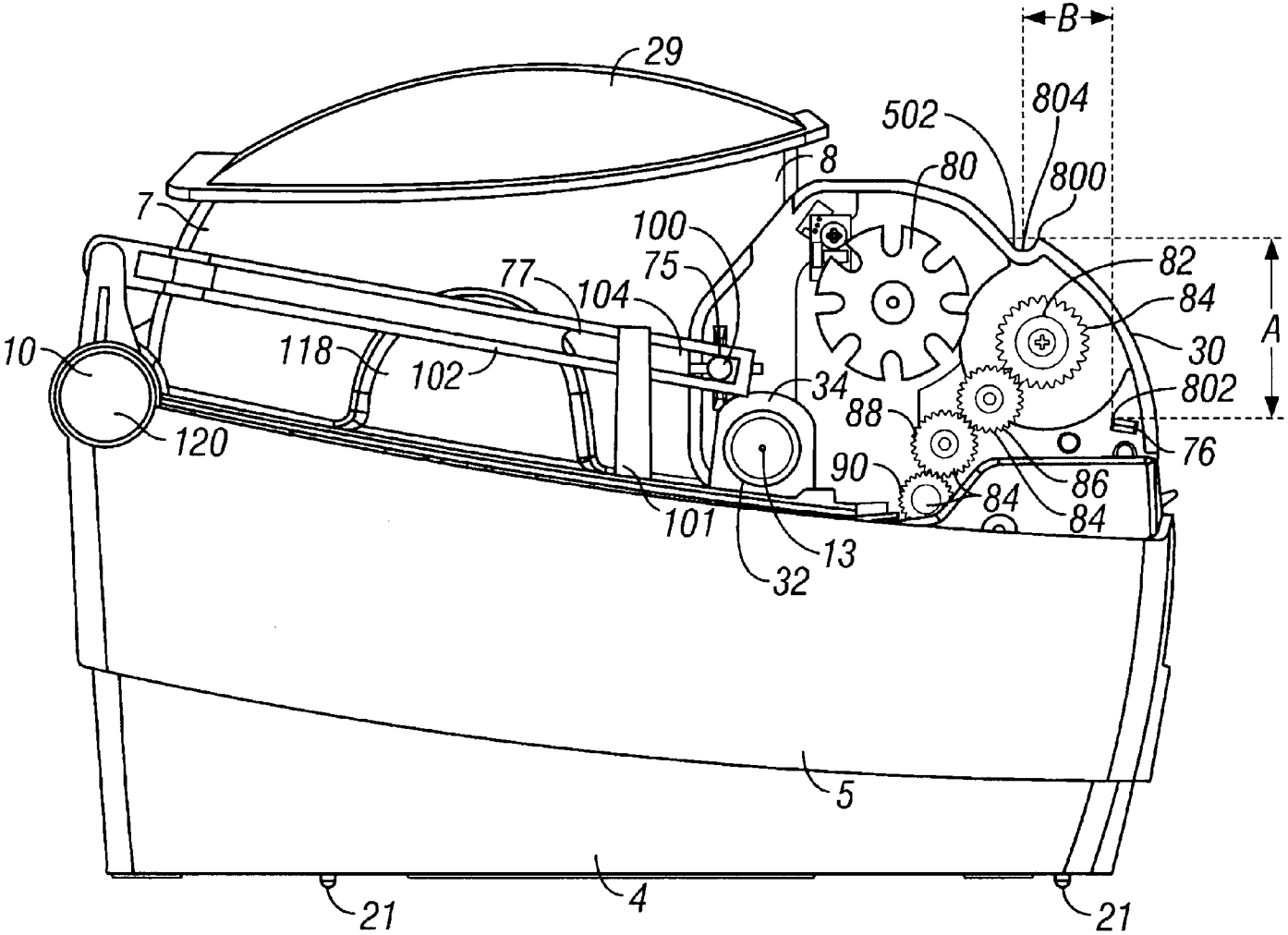
FIG. 9 is a side view of another preferred embodiment of the present invention.

If printhead 58 is in need of maintenance, the user manually folds ribbon carriage 30 fully inside lid 30 as shown in FIG. 7 for cleaning printhead 58. After cleaning printhead 58, the user may either manually fold ribbon carriage 30 out from inside lid 3 to its fully folded out state before proceeding with closing of lid 3 or leave ribbon carriage 30 in a fully folded in (inside lid 3) state and proceed with closing lid 3 whereby at some point during closing, ribbon carriage 30 by virtue of its mass (i.e. under the force of gravity) will automatically fold out of lid 3 completely after which ribbon carriage 30 will begin to rotate upwards (towards upper frame 8) about hinge axis 13 by itself. In other words, as lid 3 is being closed, ribbon carriage 30 automatically folds in lid 3 with the motion of the front edge of printhead 58 describing an upward arc 73 (FIG. 13). When lid 3 reaches a fully closed position, ribbon carriage 30 is in a fully folded in (inside lid 3) state (FIGS. 9, 14). When ribbon carriage 30 is in a fully folded in state, the position of ribbon carriage post 100 inside slot 104 is at top end 75 of slot 104 as shown, for example, in FIGS. 9, 14 in accordance with the general principles of the present invention.

In order to ensure proper positioning of floating thermal printhead 58 for printing during closing of lid 3, the angular motion of ribbon frame 30 about hinge axis 13 is timed to allow the two front edge portions of printhead 58 which are not covered by V-shaped printhead support bracket 60 (see, for example, front edge portion 57 of printhead 58 in FIG. 10) to gradually "sneak up" (align) behind alignment tabs 24, 26 as shown by arcs 85, 89 in FIG. 13. Alignment of a floating thermal printhead (such as printhead 58) behind alignment tabs (such as alignment tabs 24, 26) in a thermal transfer printer of this type is described in U.S. Pat. No. 6,068,415 to Smolenski, assigned to the assignee of the present application, the disclosure of which is incorporated herein by reference.

Furthermore, to properly bias (i.e. to apply the proper amount of pressure on) printhead 58 against platen 18 for printing, ribbon carriage 30 is provided with a pair of oppositely spaced recesses 500, 502 on the top portions of side walls 52, 51 of ribbon carriage 30, respectively, (FIG. 12) which are shaped for mating with latch shaft 17 (FIGS. 12, 15) when ribbon carriage is in a fully folded in state (inside lid 3), i.e. when lid 3 is fully closed for printer operation. Thus, latch shaft 17, which serves in this case as an end stop for the rotational movement of ribbon carriage 30 about hinge axis 13, presses against recesses 500, 502 of ribbon carriage 30 when lid 3 is fully closed (for printer operation) which translates into corresponding biasing of printhead 58 against platen 18 by way of leaf spring 70 and V-shaped printhead support bracket 60. Therefore, ribbon carriage 30 is sandwiched between latch shaft 17 and platen 18 when lid 3 is fully closed for printer operation. In this regard, a person skilled in the art would readily appreciate that distance C (FIG. 15), defined, for example, between center 700 on latch shaft axis 704 of latch shaft 17 and front edge 702 of foot 411 of latch 39 as well as distance A, defined, for example, between top edge 800 of recess 502 on side wall 51 and top edge 802 of leaf spring aperture 76 as projected in FIG. 9, and distance B, defined, for example, between bottom 804 of recess 502 on side wall 51 and top edge 802 of leaf spring aperture 76 as projected in FIG. 9 are critical distances in order to get the correct printhead spring deflection and the critical distances are tightly toleranced in order to keep the desired printhead alignment required for printing.

As shown in FIG. 5, printer hinge 10 comprises a plastic cylindrical hollow body 112 having a mounting leg 114 which has a groove 118 for mating with a corresponding hinge protrusion (not shown) provided on the underside of lower frame 6. After inserting the hinge protrusion in groove 118, mounting leg 114 is screwed to lower frame 6. Printer hinge 10 also has a substantially vertical stem 116 equipped with a lever arm 110 disposed at about 90 degrees to vertical stem 116 for insertion in aperture 108 of linkage 102 during printer assembly. Hinge 10 is also provided with a hinge cap 120 (FIGS. 1–4) which has three mounting legs (not shown) on its underside for mating with corresponding apertures 122, 124, 126 (FIG. 5).

Integral hinge 12 has a similarly shaped plastic body 122 and a plastic cap 124 (FIG. 14). To hinge upper frame 8 to lower frame 6, upper frame 8 is provided with a generally hollow cylindrical bottom end 128 (FIG. 14) which curves away from upper frame 8 and is adapted at each side for frictional insertion into hinge 10, 12, respectively (FIG. 14). For example, one side of cylindrical bottom end 128 of upper frame 8 is inserted at end 111 of hinge 10 (FIGS. 5, 14). s Other hinging configurations may be used, provided such other hinging configurations agree with the intended purpose of the present invention.

Figure 2:
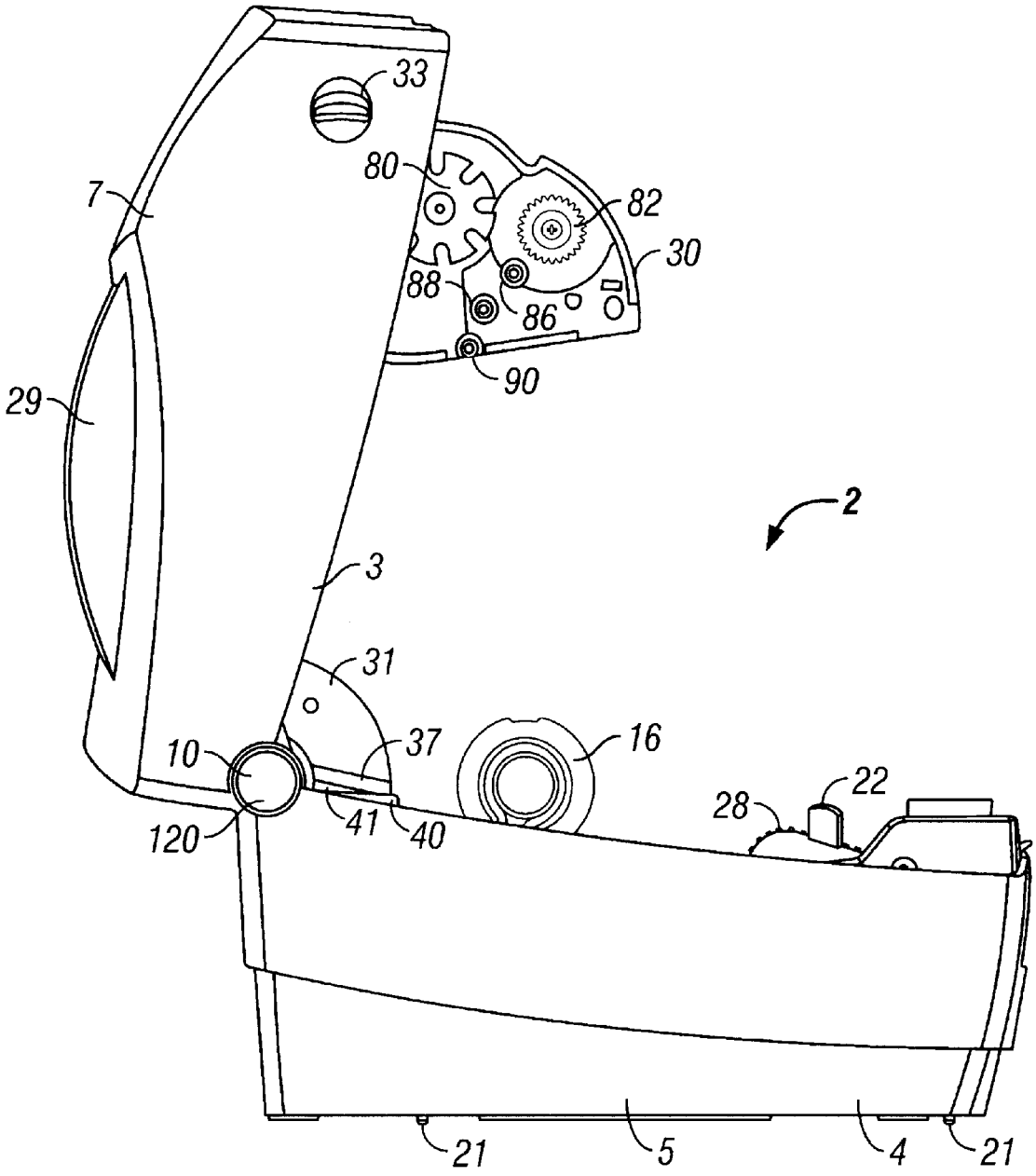
FIG. 2 is a side view of the printer of FIG. 1 in accordance with the present invention.
Figure 3:
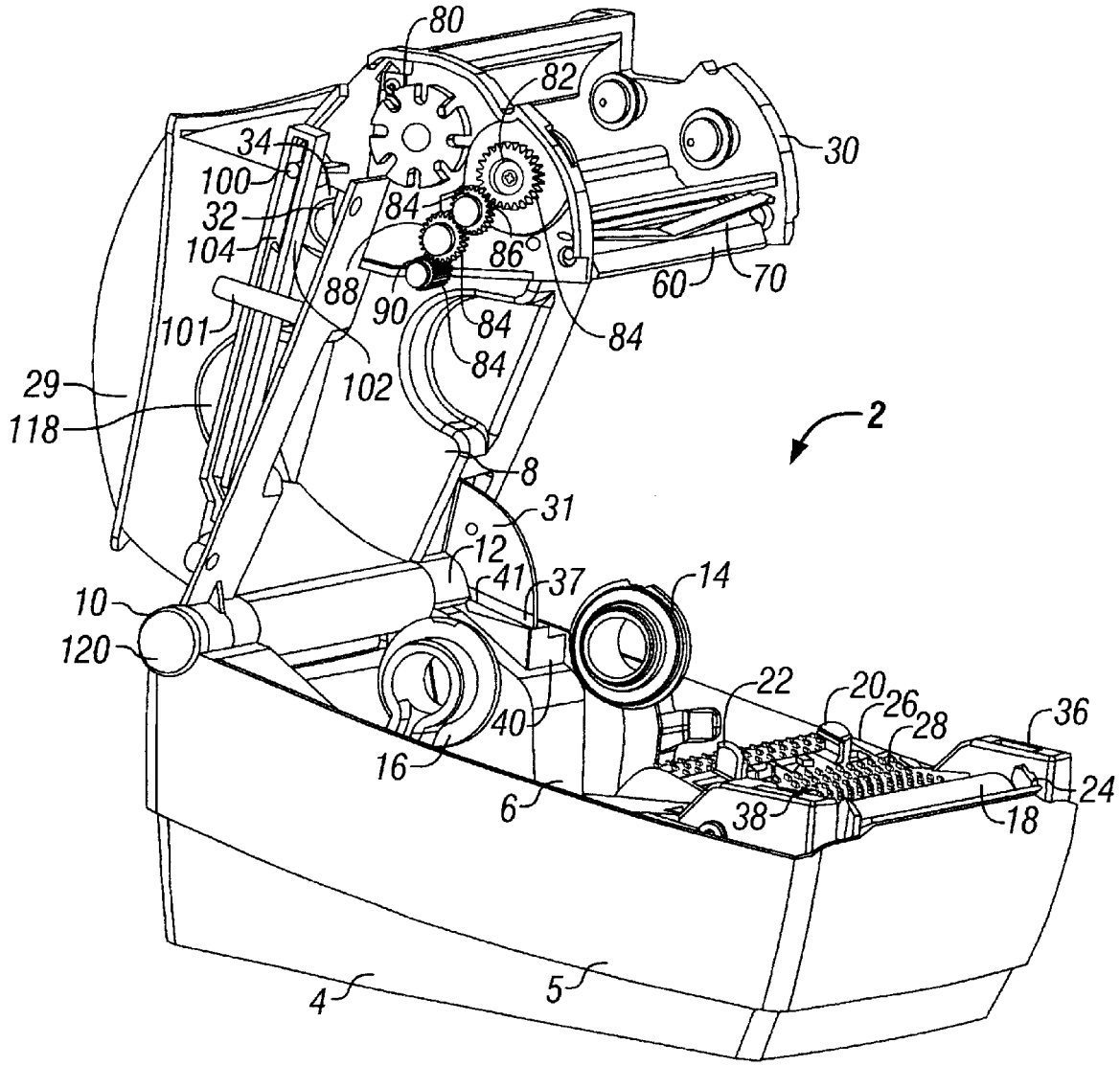
FIG. 3 is a perspective view of the printer of FIG. 1 showing the internal structure of the printer lid in accordance with the present invention.

A person skilled in the art would appreciate that the angular range of motion for lid 3 about printer hinges 10, 12 and for linkage 102 about lever arm 110 would vary based on printer configuration. As an example, lid 3 may be designed to sweep through an angle of about 83 degrees about printer hinges 10, 12 from a fully closed to a fully open position. In such a case, linkage 102 may be designed to sweep through an angle of 80.9 degrees about lever arm 110 from a fully "down" to a fully "up" position. A fully "down" position for linkage 102 would correspond to ribbon carriage post 100 being in maximum "up" position at top end 75 of slot 104 of linkage 102, i.e. lid 3 is fully closed. A fully "up" position for linkage 102 would correspond to ribbon carriage post 100 being in maximum "down" position at bottom end 77 of slot 104 of linkage 102, i.e. lid 3 is fully open (latched) and ribbon carriage 30 is folded all the way in (inside lid 3) for printhead maintenance. For the same example, the bottom of ribbon carriage 30 may be allowed to sweep through an angle of about 80 degrees about hinge axis 13 from a fully folded in to a fully folded out position (FIGS. 1, 2 and 7).

Furthermore, although printer 2 has been described so far for use as a thermal transfer printer (with ribbon), printer 2 may easily be adapted by the user for direct thermal printing by simply removing the ribbon and its associated ribbon supply and ribbon take up rolls and providing suitable print media. No other modifications to printer 2 are needed. Thus, the above-disclosed setup may also be described as a universal (thermal transfer/direct thermal) printer.

The above-described novel printer uses fewer parts than conventional printers and is designed for easy ribbon loading and equally easy media (e.g., paper) loading which is a major improvement over prior art printers. The inventive printer also provides a low cost, light-weight, and easy printhead access (for printhead maintenance) solution for the average user. Furthermore, the above-described novel lid-hinged ribbon carriage setup makes possible for the first time the loading of ribbon media without having to thread through/around the ribbon mechanism.

It should also be appreciated by a person skilled in the art that other components and/or configurations may be utilized in the above-described embodiments, provided that such components and/or configurations do not depart from the intended purpose and scope of the present invention.

While the present invention has been described in detail with regards to the preferred embodiments, it should be appreciated that various modifications and variations may be made in the present invention without departing from the scope or spirit of the invention. For example, printhead alignment may be achieved with a single appropriately configured alignment tab which would incorporate the functionality provided by alignment tabs 24, 26. In this regard it is important to note that practicing the invention is not limited to the applications described hereinabove. Many other applications and/or alterations may be utilized provided that they do not depart from the intended purpose of the present invention.

It should be appreciated by a person skilled in the art that features illustrated or described as part of one embodiment can be used in another embodiment to provide yet another embodiment such that the features are not limited to the specific embodiments described above. Thus, it is intended that the present invention cover such modifications, embodiments and variations as long as they come within the scope of the appended claims and their equivalents.

What is claimed is:

1. A printer comprising:

(a) base having a platen;

(b) a lid coupled to said base, said lid being adapted to rotate away from said base to an open position and toward said base to a closed position; and (c) a ribbon carriage coupled to said lid, said ribbon carriage being adapted to rotate out of said lid toward said platen as said lid is rotated away from said base to said open position and to rotate into said lid away from said platen as said lid is rotated toward said base to said closed position.

2. A printer comprising:

(a) a base having a platen;

(b) a lid pivotally coupled to said base and having an open position and a closed position;

(c) a ribbon mechanism movably coupled to said lid, said ribbon mechanism comprising a ribbon carriage pivotally coupled to said lid for folding in and out of said lid and adapted to removably receive a ribbon supply roll and a ribbon take up core;

(d) means for driving said ribbon mechanism and said platen when said lid is in said closed position; and (e) means for automatically presenting said ribbon mechanism for loading of ribbon when said lid is in said open position.

3. The printer of claim 2, further comprising means for pivotally coupling said ribbon carriage to said lid.

4. The printer of claim 3, wherein said pivotal coupling means includes at least one post on said ribbon carriage adapted for pivotal mating with a corresponding slot on said lid.

5. A printer comprising:

(a) a base having a platen;

(b) a lid pivotally coupled to said base and having an open position and a closed position;

(c) a ribbon mechanism movably coupled to said lid, said ribbon mechanism comprising a ribbon carriage pivotally coupled to said lid for folding in and out of said lid and adapted to removably receive a ribbon supply roll and a ribbon take up core;

(d) means for driving said ribbon mechanism and said platen when said lid is in said closed position;

(e) means for automatically presenting said ribbon mechanism for loading of ribbon when said lid is in said open position; and (f) means for latching said lid when said lid is in said open position.

6. The printer of claim 5, wherein said latching means includes at least one lid lock coupled to said lid and adapted for frictional mating with at least one lid lock slot provided on said base, said at least one lid lock slot adapted for automatically engaging said at least one lid lock in a fixed position when said lid is in said open position.

7. A printer comprising:

(a) a base having a platen;

(b) a lid pivotally coupled to said base and having an open position and a closed position;

(c) a ribbon mechanism movably coupled to said lid, said ribbon mechanism comprising a ribbon carriage pivotally coupled to said lid for folding in and out of said lid and adapted to removably receive a ribbon supply roll and a ribbon take up core;

(d) means for driving said ribbon mechanism and said platen when said lid is in said closed position;

(e) means for automatically presenting said ribbon mechanism for loading of ribbon when said lid is in said open position; and (f) a printhead resiliently coupled to said ribbon carriage.

8. The printer of claim 7, wherein said ribbon mechanism driving means includes an upper gear train coupled to a first side of said ribbon carriage for driving said ribbon take up core, a lower gear train coupled to said base for driving said upper gear train and said platen, and a stepping motor coupled to said base for driving said lower gear train when said lid is in said closed position, said stepping motor having a shaft.

9. The printer of claim 8, wherein said upper gear train comprises a take up gear for driving said ribbon take up core, a first idler gear operatively coupled to said take up gear, a second idler gear operatively coupled to said first idler gear and a transfer gear operatively coupled to said second idler gear.

10. The printer of claim 9, wherein said lower gear train comprises a pinion gear coupled to said shaft of said stepping motor, said stepping motor driving said pinion gear, a compound gear driven by said pinion gear, a third idler gear driven by said compound gear, said third idler gear operatively coupled to said transfer gear of said upper gear train when said lid is in said closed position, a platen gear coupled to a platen shaft for driving said platen, said platen gear driven by said third idler gear.

11. The printer of claim 10, further comprising means for pivotally coupling said lid to said base.

12. The printer of claim 11, wherein said pivotal coupling means includes at least one printer hinge coupled between said lid and said base.

13. The printer of claim 12, wherein said automatic ribbon mechanism presenting means includes at least one linkage pivotally coupled between said at least one printer hinge and said first side of said ribbon carriage for automatically presenting said ribbon mechanism for loading of ribbon when said lid is in said open position, said at least one linkage including a substantially elongated slot having a top end and a bottom end.

14. The printer of claim 13, further comprising means for pivotally coupling said at least one linkage to said first side of said ribbon carriage.

15. The printer of claim 14, wherein said pivotal coupling means includes a ribbon carriage post disposed away from said upper gear train on said first side of said ribbon carriage for movably engaging said substantially elongated linkage slot, said ribbon carriage post adapted to slide linearly in said substantially elongated linkage slot from a position proximate to said top end of said substantially elongated linkage slot to a position at said bottom end of said substantially elongated linkage slot when said lid moves from said closed position to said open position, said ribbon carriage adapted to fold out of said lid for automatically presenting said ribbon mechanism for loading of ribbon when said ribbon carriage post is in a position proximate to said top end of said substantially elongated linkage slot of said at least one linkage when said lid is in said open position.

16. The printer of claim 3, further comprising means for pivotally coupling said at least one linkage to said at least one printer hinge.

17. The printer of claim 16, wherein said pivotal coupling means includes at least one lever arm on said at least one printer hinge adapted to pivotally engage a corresponding aperture on said at least one linkage, said at least one linkage adapted to rotate on said lever arm when said lid moves from said closed position to said open position.

18. The printer of claim 12, further comprising means for providing access to said printhead for printhead maintenance when said lid is in said open position.

19. The printer of claim 18, wherein said printhead access means includes at least one linkage pivotally coupled between said at least one printer hinge and said first side of said ribbon carriage for providing access to said printhead for printhead maintenance when said lid is in said open position, said at least one linkage including a substantially elongated slot having a top end and a bottom end.

20. The printer of claim 19, further comprising means for pivotally coupling said at least one linkage to said first side of said ribbon carriage.

21. The printer of claim 20, wherein said pivotal coupling means includes at least one ribbon carriage post disposed away from said upper gear train on said first side of said ribbon carriage and adapted to movably engage said substantially elongated linkage slot, said at least one ribbon carriage post adapted to slide linearly in said substantially elongated linkage slot from a position at said top end of said substantially elongated linkage slot to a position at said bottom end of said substantially elongated linkage slot when said lid moves from said closed position to said open position, said ribbon carriage adapted to fold in said lid to provide access to said printhead for printhead maintenance when said at least one ribbon carriage post is positioned at said bottom end of said substantially elongated linkage slot when said lid is in said open position.

22. The printer of claim 19, further comprising means for pivotally coupling said at least one linkage to said at least one printer hinge.

23. The printer of claim 22, wherein said pivotal coupling means includes at least one lever arm on said at least one printer hinge for pivotally engaging a corresponding aperture on said at least one linkage, said at least one linkage rotating on said at least one lever arm when said lid moves from said closed position to said open position.

24. The printer of claim 7, further comprising means for aligning said resiliently coupled printhead against said platen of said base when said lid is in said closed position.

25. The printer of claim 24, wherein said aligning means includes at least one alignment tab disposed proximate to said platen on said base for aligning said printhead behind said at least one alignment tab when said lid is in said closed position.

26. The printer of claim 7, further comprising means for resiliently coupling said printhead to said ribbon carriage.

27. The printer of claim 26, wherein said resilient coupling means includes a spring loaded printhead support bracket movably coupled to said ribbon carriage and adapted to resiliently support said printhead.

28. The printer of claim 7, further comprising means for latching said lid when said lid is in said closed position.

29. The printer of claim 28, wherein said latching means includes at least one latch coupled to said lid and a latch shaft coupled to said at least one latch.

30. The printer of claim 29, further comprising means for biasing said resiliently coupled printhead against said platen of said base when said lid is in said closed position.

31. The printer of claim 30, wherein said biasing means includes at least one recess on said ribbon carriage adapted to mate with said latch shaft when said lid is in said closed position, said ribbon carriage being sandwiched between said latch shaft and said platen when said lid is in said closed position.

32. The printer of claim 27, wherein said resilient coupling means further includes a press-in clip for removably coupling at least one side of said spring loaded printhead support bracket to said ribbon carriage, said at least one side of said spring loaded printhead support bracket and said ribbon carriage adapted to removably couple to said press-in clip.

* * * * *